US006175333B1

(12) United States Patent
Smith et al.

(10) Patent No.: US 6,175,333 B1
(45) Date of Patent: Jan. 16, 2001

(54) DUAL BAND ANTENNA

(75) Inventors: Martin Smith; Roger Adrian Perrott, both of Chelmsford (GB)

(73) Assignee: Nortel Networks Corporation, Montreal (CA)

( * ) Notice: Under 35 U.S.C. 154(b), the term of this patent shall be extended for 0 days.

(21) Appl. No.: 09/339,604

(22) Filed: Jun. 24, 1999

(51) Int. Cl.[7] ..... H01Q 1/38
(52) U.S. Cl. ..... 343/700 MS; 343/778; 343/770
(58) Field of Search ..... 343/700 MS, 767, 343/778, 769, 770; H01Q 1/38

(56) References Cited

U.S. PATENT DOCUMENTS

| | | | | |
|---|---|---|---|---|
| 4,141,012 | | 2/1979 | Hockham et al. | 343/729 |
| 4,740,795 | | 4/1988 | Seavey | 343/786 |
| 4,801,945 | | 1/1989 | Luly | 343/786 |
| 4,926,189 | * | 5/1990 | Zaghloul et al. | 343/700 MS |
| 4,929,959 | * | 5/1990 | Sorbello et al. | 343/700 MS |
| 5,005,019 | * | 4/1991 | Zaghloul et al. | 343/700 MS |
| 5,061,943 | * | 10/1991 | Rammos | 343/770 |
| 5,434,580 | | 7/1995 | Raguenet et al. | 343/700 MS |
| 5,534,877 | * | 7/1996 | Sorbello et al. | 343/700 MS |
| 5,745,079 | * | 4/1998 | Wang et al. | 343/700 MS |

FOREIGN PATENT DOCUMENTS

| | | |
|---|---|---|
| 0463649A1 | 1/1992 | (EP) . |
| 2241832B | 9/1991 | (GB) . |

* cited by examiner

*Primary Examiner*—Don Wong
*Assistant Examiner*—Shih-Chao Chen
(74) *Attorney, Agent, or Firm*—Lee, Mann, Smith, McWilliams, Sweeney & Ohlson

(57) ABSTRACT

A flat-plate dual band antenna element is described which comprises two superposed sets of excitation probes and apertures each of which operates in a different frequency band. These antenna elements are used in an array together with a plurality of single band elements to create a flat-plate, dual band array antenna that is low cost and permits monopulse alignment methods and distributed power amplification to be used. The geometric arrangement of the antenna elements is such that distribution networks for the excitation probes can be accommodated in the limited space available. Dual band flat-plate array feeds for a reflector antenna are also described. These use either a combination of the above mentioned dual band antenna elements and single band antenna elements or alternatively, two sizes of single band antenna elements. The geometric arrangement of the antenna elements in these array feeds is such that transmit and receive beams are provided that have co-incident phase centers and approximately equal beamwidths.

27 Claims, 7 Drawing Sheets

DUAL BAND ANTENNA

BACKGROUND OF THE INVENTION

The invention relates to dual band antennas including but not limited to dual band flat plate array antennas and dual band array feeds for reflector antennas. The invention also relates to a dual band flat-plate array element for use as part of a dual band flat plate array antenna.

Domestic satellite communication antennas are widely used to receive signals such as television broadcasts rather than to transmit as well as receive. However, demand for interactive services such as interactive television and use by small office/home office users has led to the requirement for domestic two-way satellite communication to be provided.

This is possible by using two antennas, one for an up-link or transmission signal and one for a down-link or reception signal. However, this increases the cost of the equipment needed by a subscriber and also increases installation, transport and maintenance costs. The space required for the antennas is also greater and this is a particular problem for domestic applications where space is at a premium.

The up-link and down-link signals are provided at different frequency bands in order that they are readily distinguishable and do not interfere. Antennas which provide two frequency bands are referred to as dual band antennas and a number of different types of dual band antennas are known. However, these suffer from a number of drawbacks when considering subscriber satellite communication systems.

For example, frequency selective surfaces can be used to provide dual bands as in earth station antennas. FIG. 12 is a schematic diagram showing use of a frequency selective surface 131. Signals from a transmitter 131 reflect from the frequency selective surface 133 and onto a reflector 130. However, signals received at a different frequency and reflected from reflector 130 towards the frequency selective surface pass through that surface 131 towards a receiver 132. That is, the frequency selective surface is arranged to reflect signals of a certain frequency range and transmit others. In this way dual band communication using only one main reflector 130 is possible. However, this type of system is difficult and expensive to install because four components, the transmitter 131, receiver 132, frequency selective surface 133 and reflector 130, must all be correctly aligned. This is difficult to achieve at low cost. Another problem is that cabling must be provided to the transmitter and receiver separately because these have different locations. This also increases installation costs.

Another approach has been to provide a dual band feed for a reflector antenna. For example, this type of system is described in U.S. Pat. No. 4,740,795, Seavey. Two coaxial waveguides are used for the respective two frequency bands and in order that the beamwidth of each beam is similar (and arranged to cover the reflector surface) these waveguides are of different diameter. In order to accommodate this arrangement the design is complex and expensive. In addition, dual band feed systems such as that described in Seavey are not suitable for monopulse alignment methods or for distributed power amplification.

Monopulse alignment methods enable an antenna to be accurately aligned with respect to a satellite and this is particularly important in subscriber satellite communication applications where there is typically little room for alignment error and where costs for an operator to align an antenna are high. Distributed power amplification is advantageous because high power transmit amplifiers are not readily available at millimetric frequencies. In dual band feed systems such as the Seavey system, distributed power amplification is not possible because there is only one transmit antenna element.

U.S. Pat. No. 4,141,012, Hockham et al. describes a dual band waveguide radiating element for an antenna. Using this element an array antenna which operates at two frequencies can be provided. The waveguide element is excited by probe structures entering the guide perpendicular to the plane of the array face. This has significant cost and size implications because the antenna is not a "flat-plate". Also, in terms of the number of elements being fed the approach described in U.S. Pat. No. 4,141,012 is inefficient.

A general rule in antenna design is that, in order to "focus" the available energy to be transmitted into a narrow beam, a relatively large "aperture" is necessary. The aperture may be provided by a broadside array, a longitudinal array, an actual radiating aperture such as a horn, or by a reflector antenna which, in a receive mode, receives a collimated beam of energy and focuses the energy into a converging beam directed toward a feed antenna, or which, in a transmit mode, focuses the diverging energy from a feed antenna into a collimated beam.

Those skilled in the art know that antennas are reciprocal devices, in which the transmitting and receiving characteristics are equivalent. Generally, antenna operation is referred to in terms of either transmission or reception, with the other mode being understood therefrom.

It is accordingly an object of the present invention to provide a dual band antenna which overcomes or at least mitigates one or more of the problems noted above.

Further benefits and advantages of the invention will become apparent from a consideration of the following detailed description given with reference to the accompanying drawings, which specify and show preferred embodiments of the invention.

SUMMARY OF THE INVENTION

According to a first aspect of the present invention there is provided a dual band flat plate antenna array element comprising:

(i) at least one transmit probe positioned between two first metal plates, the metal plates each containing an aperture of the same size and shape, and the apertures in the first metal plates being positioned one above the other and overlying the transmit probe;

(ii) at least one receive probe positioned between two second metal plates, the second metal plates each containing an aperture of the same size and shape and the apertures in the second metal plates being positioned one above the other and overlying the receive probe; and wherein said apertures in the first and second metal plates are superimposed, the apertures in the first metal plates being of a different size from that of the apertures in the second metal plates.

This has the advantage that a compact, low cost antenna element is provided that operates at two frequency bands and which has a flat-plate form.

According to a second aspect of the present invention there is provided a dual band flat plate array antenna comprising a plurality of dual band flat plate antenna array elements each comprising:

(i) a transmit probe positioned between two first metal plates, the metal plates each containing an aperture of the same size and shape, and the apertures in the first metal plates being positioned one above the other and overlying the transmit probe;

(ii) a receive probe positioned between two second metal plates, the second metal plates each containing an aperture of the same size and shape and the apertures in the second metal plates being positioned one above the other and overlying the receive probe; and wherein said apertures in the first and second metal plates are superimposed, the apertures in the first metal plates being of a different size from that of the apertures in the second metal plates.

This has the advantage that by superimposing the first and second metal plates a compact and low cost array antenna is provided that operates at two frequency bands. Monopulse alignment methods can be used to correctly align the antenna during installation and this reduces installation costs. Also, distributed power amplification can be used.

According to a third aspect of the present invention there is provided a flat-plate array feed for a reflector antenna said array feed comprising:

(i) a plurality of dual band antenna elements; and (ii) a plurality of single band antenna elements; wherein the geometric arrangement of said antenna elements is such that a receive and a transmit antenna beam are provided with approximately equal beamwidths and approximately equal phase centers.

In this way a low cost, dual band, compact, array feed is formed for a reflector antenna.

According to a fourth aspect of the present invention there is provided a flat-plate array feed for a reflector antenna said array feed comprising:

(i) a plurality of dual band antenna elements; and (ii) a plurality of single band antenna elements; wherein said antenna elements are arranged in an array and the geometric arrangement of said antenna elements is such that a receive and a transmit antenna beam are provided with approximately equal phase centers. In this way a low cost, dual band, compact, array feed is formed for a reflector antenna. Preferably a distribution network is provided, connected between a plurality of said antenna elements, and arranged to taper the illumination of said plurality of antenna elements such that in use a receive and a transmit antenna beam are provided with approximately equal beamwidths.

According to another aspect of the present invention there is provided a flat-plate array feed for a reflector antenna said array feed comprising a plurality first single band antenna elements that are arranged to operate within a first frequency band; a plurality of second single band antenna elements that are arranged to operate within a second frequency band; and wherein the geometric arrangement of said first and second antenna elements is such that a transmit and a receive antenna beam are provided with approximately equal beamwidths and approximately equal phase centers.

According to another aspect of the present invention there is provided a reflector antenna comprising a flat-plate array feed said flat-plate array feed comprising:

(i) a plurality of dual band antenna elements; and (ii) a plurality of single band antenna elements; wherein the geometric arrangement of said antenna elements is such that a receive and a transmit antenna beam are provided with approximately equal beamwidths and approximately equal phase centers.

According to another aspect of the present invention there is provided a reflector antenna comprising a flat-plate array feed said flat-plate array feed comprising:

(i) a plurality of dual band antenna elements; and (ii) a plurality of single band antenna elements; wherein said antenna elements are arranged in an array and the geometric arrangement of said antenna elements is such that a receive and a transmit antenna beam are provided with approximately equal phase centers.

According to another aspect of the present invention there is provided a reflector antenna comprising a flat-plate array feed said flat-plate array feed comprising: a plurality first single band antenna elements that are arranged to operate within a first frequency band; a plurality of second single band antenna elements that are arranged to operate within a second frequency band; and wherein the geometric arrangement of said first and second antenna elements is such that a transmit and a receive antenna beam are provided with approximately equal beamwidths and approximately equal phase centers.

According to another aspect of the present invention there is provided a dual band flat-plate array for use in an antenna said flat-plate array comprising:

a first plurality of antenna elements being arranged to transmit signals within a first frequency range and a second plurality of antenna elements being arranged to receive signals within a second frequency range.

DETAILED DESCRIPTION OF THE EMBODIMENTS

Embodiments of the present invention are described below by way of example only. These examples represent the best ways of putting the invention into practice that are currently known to the Applicant although they are not the only ways in which this could be achieved.

Figure 15:
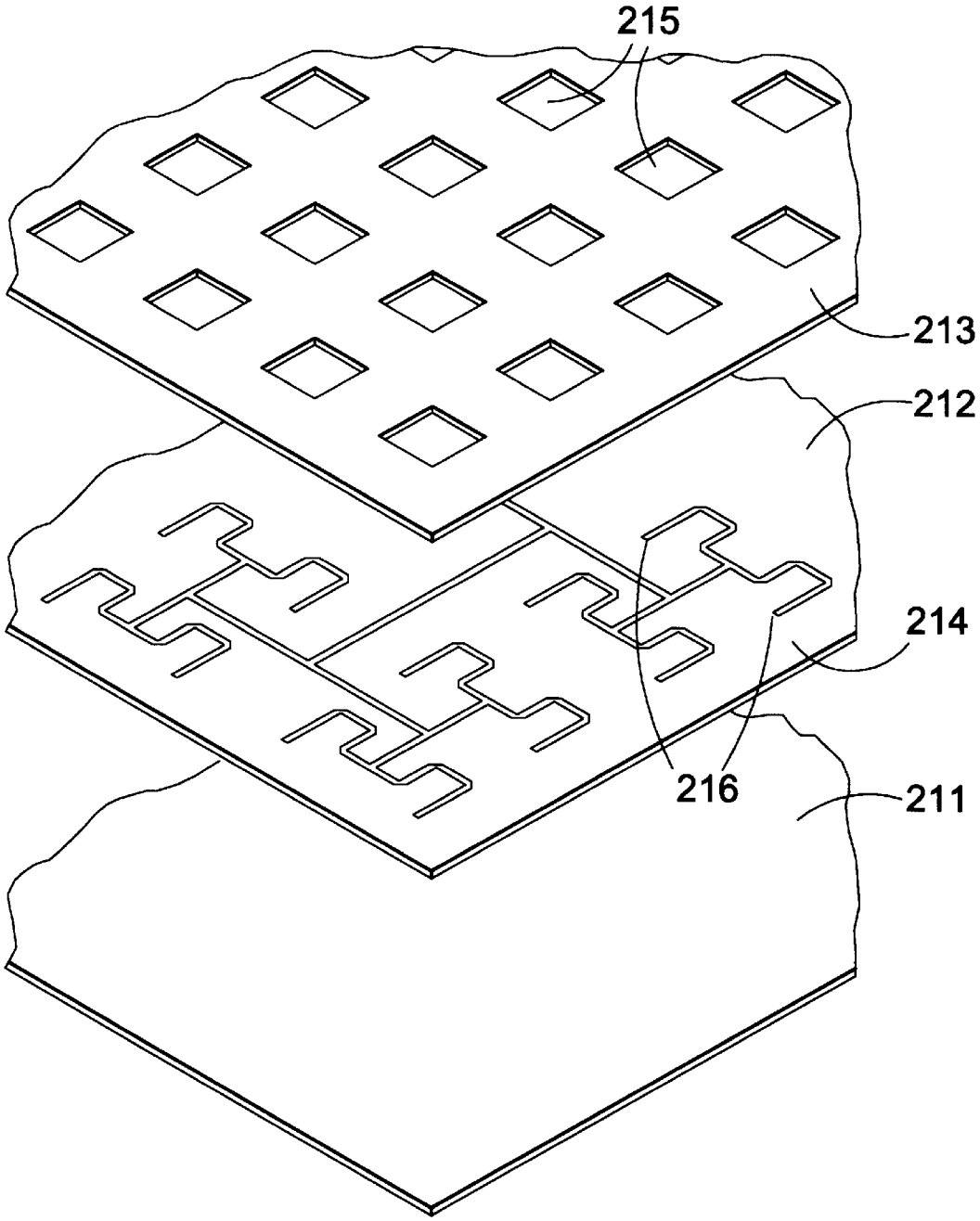
Fig.15 PRIOR ART
FIG. 15 is an exploded view of a flat-plate antenna array according to the prior art.

FIG. 15 illustrates the structure of a flat-plate array antenna according to the prior art as described in European patent application EP0463649A1 and similarly described in UK patent GB 2241832B (Twelves). A back-plate 211 is provided which is made from aluminium or other electrically conducting material. Above the back-plate 211 a power supply circuit plate 212 is placed. This power supply circuit plate 212 is formed from plastics material or other electrically insulating material. On the power supply circuit plate 212 a power supply circuit pattern, or distribution network, 214 of conducting strips is formed for connection to means for controlling the antenna. This pattern 214 forms a type of "tree" structure with many terminations 216. Each termination 216 is called a probe, and the probes are arranged in an array. Above the power supply circuit plate 212 a radiation plate 213 or top plate is provided. This is formed from electrically conducting material such as aluminium and contains a plurality of apertures 215 arranged in an array. The array of apertures 215 corresponds to the array of probes in the power supply circuit plate 212 so that when the radiation plate 213 is placed over the power supply circuit plate 212 each probe projects into a region below an aperture 215. Each probe and aperture combination then forms an antenna element which enables radiation such as signals (of a certain frequency band) from a satellite to be received. That is, this type of flat-plate array only operates for one frequency band according to the size of the apertures 215 in the radiation plate 213 and the size of the spaces between these apertures. The back plate 211, power supply circuit plate 212 and radiation plate 213 are typically spaced apart using plastic foam inserts (not shown). Downstream of the flat-plate antenna there is connected an electronic device, particularly a converter, which processes the signals according to the particular application. Coupling of the flat-plate antenna and the electronic processor device is in most cases by means of a hollow waveguide with capacitive coupling-in of the radiation summation signal.

The present invention provides a flat-plate antenna array which operates at two frequency bands. For example, a particular embodiment provides a flat-plate antenna for Ka band satellite communication access units where the transmit (Tx) band is close to 30 GHz and the receive (Rx) band is close to 20 GHz. In order to enable a flat-plate antenna to operate at two frequency bands two superimposed layers of probes and apertures are provided. The apertures in the different layers are effectively superimposed, aligned or positioned in register. Each layer of probes requires its own distribution network or power supply circuit pattern 214 and this creates a problem because there is limited space. That is, only the probes 216 of the distribution networks should be exposed beneath an aperture 215 and the rest of the distribution network must be contained within the space between the apertures 215. However, before now this has proved difficult to achieve especially because the spacing between the apertures is required to be less than 1 wavelength in order that grating lobes are not created. As well as this the apertures 215 themselves are preferably about ½ a wavelength in diameter for efficient operation of the antenna.

Figure 3:
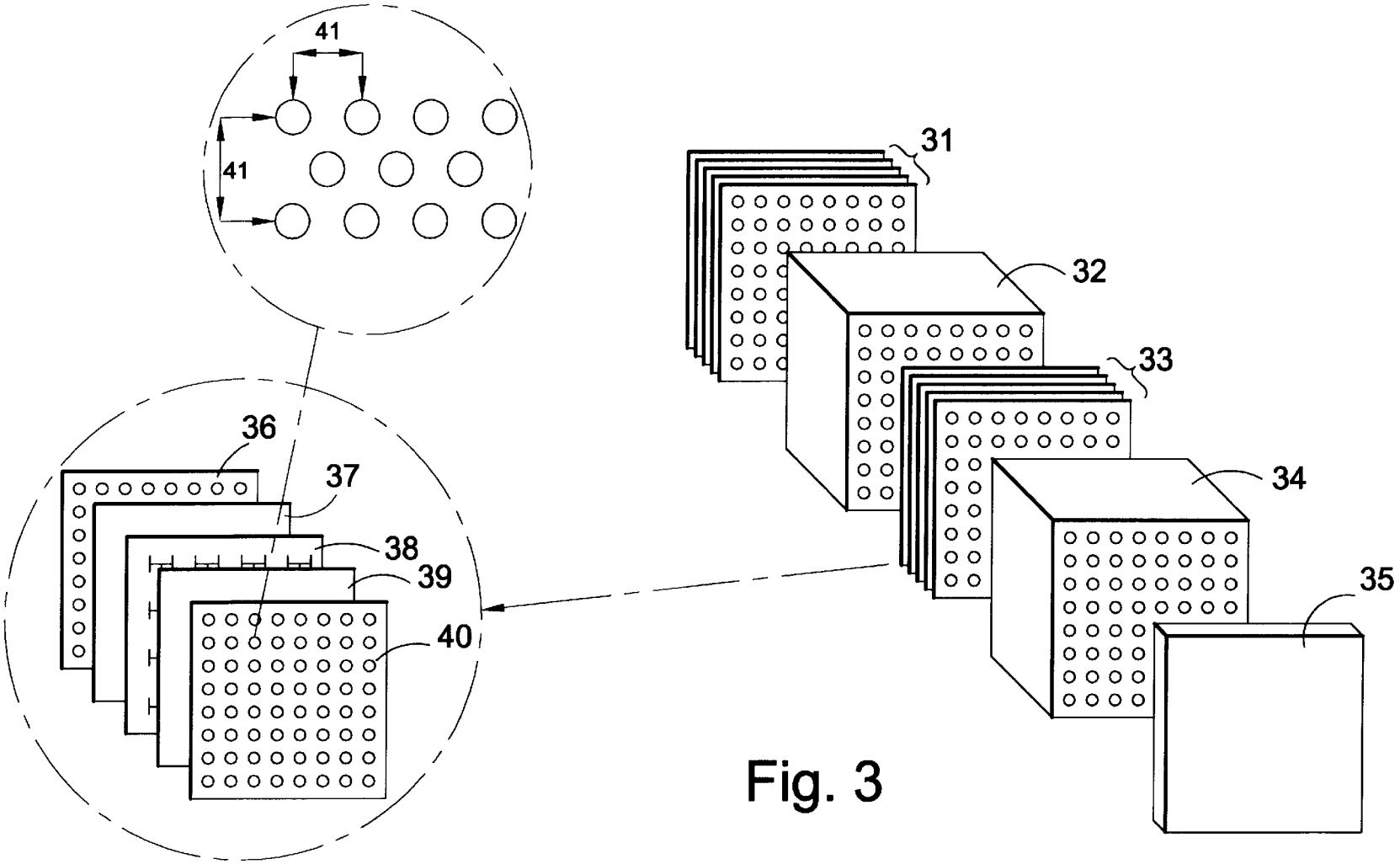
FIG. 3 is an exploded view of a dual band flat-plate array antenna.

FIG. 3 is an exploded view of a dual band flat-plate array antenna according to an embodiment of the present invention. In order for the antenna to operate at two frequency bands, two layers or triplates 31, 33 are provided one for transmitting and one for receiving. Each triplate 31, 33 comprises a power supply circuit plate 38 which is firmed from plastic film or other suitable electrically insulating material and upon which probes and a distribution network are provided. Any suitable form of probes and distribution network can be used. For example, pairs of probes which are orthogonally positioned with respect to one another (to create circularly polarised signals) may be formed with each pair of probes forming part of an individual antenna element. The probes of each pair are connected to each other by stripline sections (not shown) and all the stripline sections are connected to a common stripline feed structure (not shown) in accordance with known techniques to effect reception or transmission of signals in the required frequency bands. Each triplate 31, 33 also comprises a back punched plate 40 and a radiation plate 36 both of which contain a corresponding array of apertures. The back punched plate 40 and radiation plate 36 are formed from aluminium or other suitable electrically conducting material. The plates within each triplate 31, 33 are spaced apart using foamed plastic spacers 37, 39.

The two triplates 31, 33 differ from one another in the sizes of the apertures in the radiation plate 36 and the back punched plate in order that each triplate operates at a different frequency band. The center-to-center spacing between the apertures should be less that one wavelength in order that grating lobes are avoided. However, it is also required to increase the center-to-center spacing between the apertures as much as possible in order to increase the space available for the distribution network. For a given triplate, the apertures preferably have a diameter of about ½ a wavelength, although the apertures are designed to be as small as practically possible for efficient operation of the antenna.

In the embodiment being described the diameter of the apertures is 4.5 mm for the triplate 33 closest the back-plate 35 of the antenna (this is because the transmit frequency is about 30 GHz which gives a wavelength of about 10 mm, just less than half of which is about 4.5 mm). However, for the triplate 31 furthest from the back-plate 35 the diameter of the apertures is 6.75 mm. In this case the receive frequency is about 20 GHz which gives a wavelength of about 15 mm, just less than half of which is about 6.75 mm.

The beamwidth associated with each triplate is related to the aperture spacing and it is not necessary for these beamwidths to be equal. For example, the transmit beamwidth for a subscriber satellite communication system can be smaller than for the receive beamwidth.

The triplates 31, 33 themselves are also spaced apart using a spacer 32 formed from foamed plastic material or other suitable electrically insulating material. This spacer 32 contains apertures in an array and for this reason is termed a "honeycomb spacer". The apertures in the honeycomb spacer are arranged to correspond with the apertures in the triplates 31, 33 although the apertures of the honeycomb spacer are of larger diameter (for example, 8 mm in a preferred embodiment). Also, the internal walls of the apertures in the honeycomb spacer are metallised or coated with other electrically conducting material.

A similar honeycomb spacer 34 is also provided between the lower triplate 33 and an antenna back-plate 35 which forms the back of the flat plate antenna array. In a particular embodiment the thicknesses of the components in each triplate 31, 33 are as follows:

| | |
|---|---|
| Radiation plate | 0.6 mm |
| Plastic foam spacer | 1 mm |
| Power supply circuit layer | 0.1 mm |
| Plastic foam spacer | 1 mm |
| Back punched plate | 0.6 mm |

Figure 1:
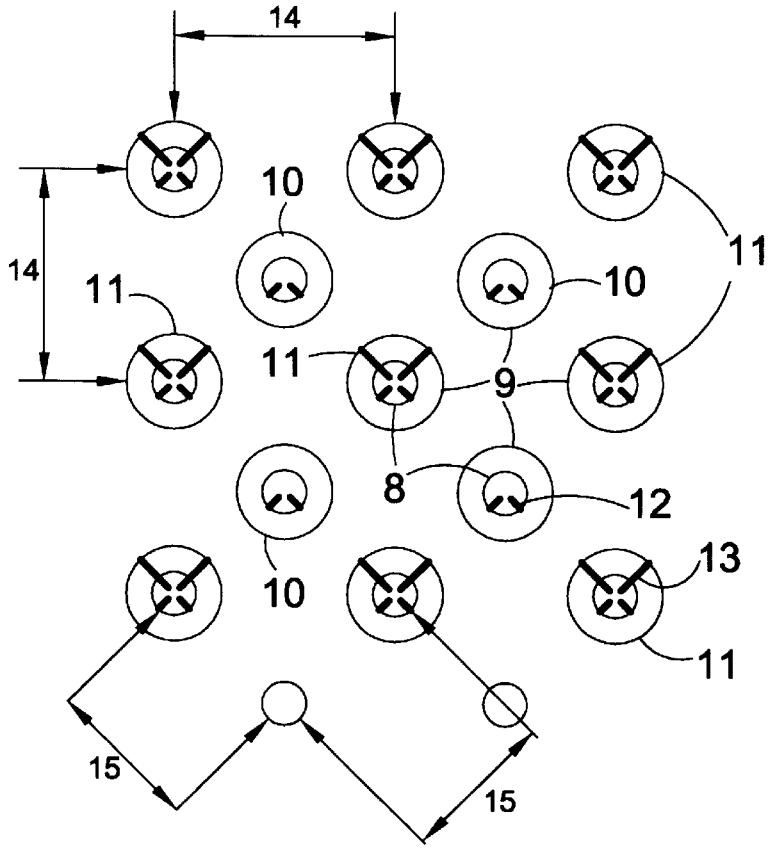
FIG. 1 is a schematic diagram of superposed and interleaved elements of a dual band flat-plate array antenna.

FIG. 1 effectively shows a plan view from above part of a flat-plate antenna array according to the present invention. The apertures 9 in the uppermost triplate 31 are visible and through these receive probes 13 in the distribution layer of the uppermost triplate 31 are visible. These receive probes 13 are adapted to receive satellite signals in the 20 GHz band. In a preferred embodiment the diameter of the apertures 9 in the uppermost triplate 31 is 6.75 mm.

The lower triplate 33 contains apertures of a smaller diameter (for example, 4.5 mm), and the edges of these apertures 8 are visible through the apertures 9 in the uppermost triplate 31. Pairs of transmit probes 12 in the distribution layer of the lower triplate 33 are visible through apertures 8 and 9. These transmit probes 12 are adapted to transmit satellite signals in the 30 GHz band.

As illustrated in FIG. 1, a pair of transmit probes 12 is visible through each of the apertures 8. However, pairs of receive probes 13 are only present in some of the apertures 9. The apertures in the uppermost triplate 31 can be thought of as a "receive grid" and this receive grid is only partially populated with receive probes 13. In a preferred embodiment the receive grid is 50% populated with pairs of receive probes 13. This means that some of the apertures 10 act as transmit only elements, whilst others 11 act as transmit and receive elements because they overlie both a pair of transmit and a pair of receive probes. It is not essential to feed all the receive elements because this does not affect the beamwidth of the triplate. The gain of the receive beam may be reduced with respect to the transmit beam but this is acceptable to a certain extent according to the particular situation involved. By arranging for the receive grid to be only partially populated the distribution network is reduced in size and can be more easily accommodated in the space available. In the example discussed above the receive grid is 50% populated, however other percentages of the total number of elements can be used as receive elements according to the particular application involved.

In the embodiment being discussed, the Tx band is about 30 GHz and the Rx band about 20 GHz. This gives a 1:1.5 ratio in wavelengths between the two bands. This means that the element spacing for the receive elements and the transmit elements should be in approximately the same ratio in order that the spacing is always just less than one wavelength. In the present embodiment this is achieved as illustrated in FIG. 1. The transmit elements (e.g. all the elements shown in FIG. 1) are arranged in a square grid with the vertical axis of the grid being inclined at 45° to the vertical axis of the page. Similarly, the receive elements 11 (of which 9 are illustrated in FIG. 1) are arranged in a square grid. However, this receive grid is arranged with its vertical axis parallel to the vertical axis of the page. That is the transmit grid is positioned at 45° to the receive grid and can be considered as being rotated 45° with respect to the receive grid. The element spacing 14 for the receive grid is 13.4 mm (just less than the receive wavelength which is about 15 mm) in a preferred embodiment whereas the element spacing 15 for the transmit grid is smaller, being 9.48 mm (just less than the transmit wavelength which is about 10 mm) in the preferred embodiment.

By arranging the transmit and receive grids at 45° to each other in this way the ratio of the element spacings for the two grids is $1:2^{1/2}$ and this is approximately a 1:1.5 ratio as required for the 30 GHz and 20 GHz frequency bands. This arrangement of the transmit and receive grids is particularly advantageous because it provides a large amount of space between the antenna elements in order for the distribution network to be accommodated.

Transmit and receive frequency bands that are closer in frequency than the 20 GHz and 30 GHz examples can also be used. However, as these frequency bands become closer it is more difficult to distinguish between transmit and receive signals and interference between these two channels may occur. If frequency bands further apart in frequency that the 1:1.5 ratio are used then it rapidly becomes difficult to accommodate the distribution network without detrimenting the performance of the antenna. For example, frequency bands with a ratio of 2:1 may be used but for frequency bands further apart than this it becomes difficult to form a working arrangement. Another way of describing the relationship between the transmit and receive grids is to consider that these grids are rotated with respect to one another such that it is possible to substantially superimpose the elements of the two grids.

Figure 2:
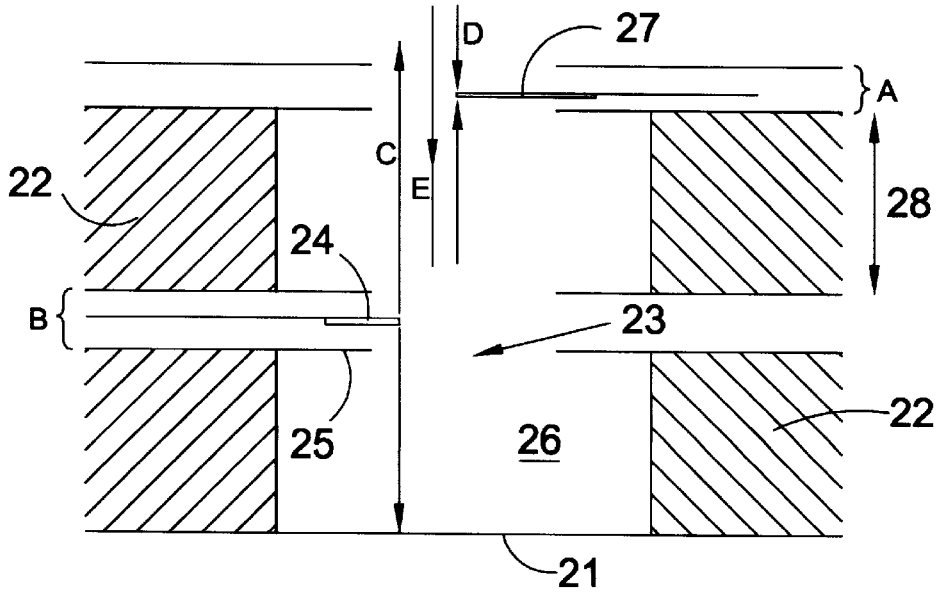
FIG. 2 is a schematic cross-section through a dual band flat plate array element.

FIG. 1 also illustrates the geometric arrangement of the apertures 8,9. The combination of two superimposed apertures 8,9 and any probes visible through these apertures will be referred to as an array element. Where only a transmit probe is present that array element is referred to as a "transmit only" element. FIG. 2 is a cross-section through one of the array elements of FIG. 1 which has a transmit probe 24 and a receive probe 27. The uppermost triplate is illustrated schematically as A and the lower triplate as B. A honeycomb spacer 22 is provided between the triplates A, B as described above and another honeycomb spacer 22 between the lower triplate B and a back antenna plate 21.

Considering the lower distribution layer first, transmit probe 24 emits radiation which travels upwards through the superimposed apertures in the triplates and away from the antenna. This is indicated by arrow C in FIG. 2. Radiation from the transmit probe 24 which travels in the opposite direction towards the back antenna plate 21 is reflected from that plate and so directed out of the antenna. The honeycomb spacers 22 contain apertures of larger diameter than the apertures in the triplates and the metallised internal walls of the honeycomb apertures act as waveguides to channel or propagate radiation from the transmit probe 24 out of the antenna. In a preferred embodiment the diameter of the honeycomb apertures is 8 mm. This diameter should be large enough in order that the radiation may propagate along the aperture but must not be larger than the spaces between the apertures in the punched plates. That is, the diameter of the honeycomb apertures is constrained by the spacing or the apertures in the punched plates. However, it is not essential to use the honeycomb spacers or to provide alternative waveguides to propagate the radiation.

Receive probe 27 receives radiation which enters the array element in the direction of arrow D. Radiation which enters the aperture in the honeycomb spacer 22 (for example in the direction of arrow E) is within the 20 GHz beamwidth. The aperture size 23 in the lower triplate B is smaller than that of the upper triplate and arranged such that the 20 GHz received radiation is of too large a wavelength to enter the lower triplate B. This means that radiation which enters the aperture in the honeycomb spacer 22 is effectively reflected back towards the receive probe 27. Also, the depth 28 of the honeycomb spacer is arranged to be about ½ of the wavelength of the received radiation. This means that any reflected radiation reinforces with radiation directly received at the receive probe 27 from the same source. Similarly, the depth of the honeycomb spacer below the transmit probe 24 is arranged to be about ½ of the wavelength of the transmitted radiation.

Another embodiment of the present invention which relates to a dual band array feed for a reflector antenna is now described. Two antenna beams are created using the array feed, one for an up-link communication channel and one for a down-link communication channel. These antenna beams must have approximately co-incident phase centers and approximately equal beamwidths in order to illuminate a reflector effectively and efficiently. As well as this the array feed should be low cost, enable monopulse alignment methods and distributed power amplification to be used and also be small in size.

Figure 6:
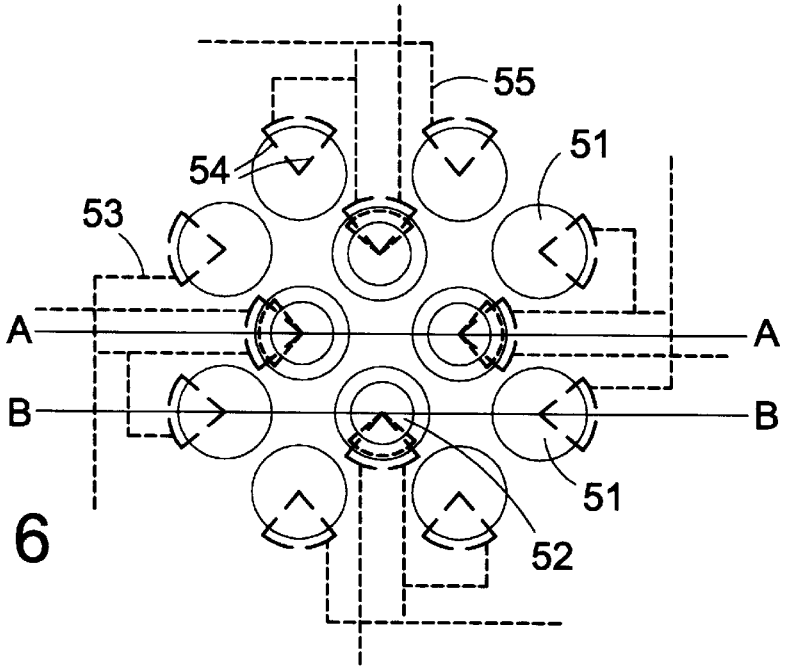
FIG. 6 is a schematic diagram of another example of a dual band array feed for a reflector antenna.

FIG. 6 shows a first example of a dual band array feed for a reflector antenna. In this case the array feed is arranged to provide two frequency bands, one at around 20 GHz and one at around 30 GHz, and is therefore termed a "Ka—Ka" reflector feed. The array feed comprises four dual band antenna elements 52 which are similar to those described above for the flat plate antenna array. In addition eight single band antenna elements 51 are provided. Each single band antenna element 51 comprises a pair of probes 54 which are connected to a distribution network 55 as described above for the flat plate antenna array. Each dual band antenna element 52 has two pairs of probes (shown as superimposed dotted lines in FIG. 6) which are also connected to the distribution network 55. The problem of providing enough space between the antenna elements 51, 52 in order to accommodate the distribution network arises again as for the flat plate antenna array described above although this problem is not quite so acute because the array feed is small so that the distribution network can be accommodated to some extent in the area around the outside of the array feed. As for the flat plate antenna array the spacing between the elements should be less that one wavelength in order that grating lobes are not created. Because the array feed is smaller than the array for the flat plate antenna discussed above, grating lobes occur for element spacings that are further from one wavelength than would otherwise have been the case. As for the flat plate antenna the aperture sizes are preferably about ½ a wavelength but again should be as small as possible to accommodate the distribution network.

The single band elements 51 (which are "receive only") and the dual band elements 52 together form an array which is a 4 by 4 grid from which the four corner elements are missing. The dual band array elements 52 are positioned as the central four elements of this array.

Considering the transmit elements first, these are provided by the four dual band array elements 52. The transmit elements 52 form a grid (in this case of four elements) with a spacing of just less than one wavelength, which for a transmit wavelength of about 10 mm gives a spacing of about 8.5 mm for example. The diameter of these elements should be about ½ a wavelength, for example 5 mm. The beamwidth is related to the wavelength divided by the length of one row of the transmit grid which in the present example is about 10/(2×8.5) radians.

Now considering the receive elements, all the elements 51, 52 are receive elements. These elements are formed into a grid with a similar spacing as the transmit grid in order that the elements of the transmit grid are superposed by those of the receive grid. This gives a spacing of about 8.5 mm which is less than one wavelength, one receive wavelength being about 15 mm. The beamwidth of the receive element grid is related to the wavelength divided by the length of one row of the receive grid. In the example shown in FIG. 6 the length of one row is equivalent to 4 element spacings which is about 34 mm giving a beamwidth of about 15/34 radians. From this it can be seen that the beanwidth for the transmit grid is larger than that for the receive grid. In order to compensate for this, the beamwidth of the receive grid is effectively increased by tapering the illumination. That is, the activation of the probes for the receive elements is reduced as compared to the probes for the transmit elements (in this example by 50%).

Figure 7:
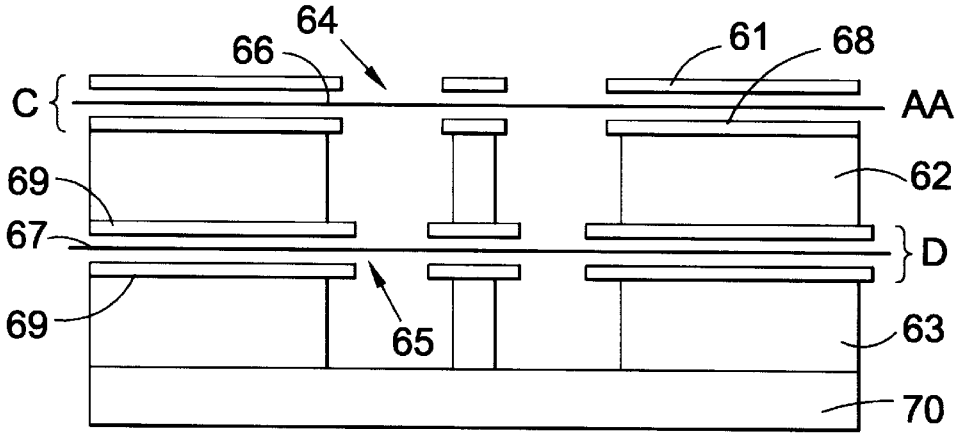
FIG. 7 is a cross-section along line A—A of FIG. 6.
Figure 8:
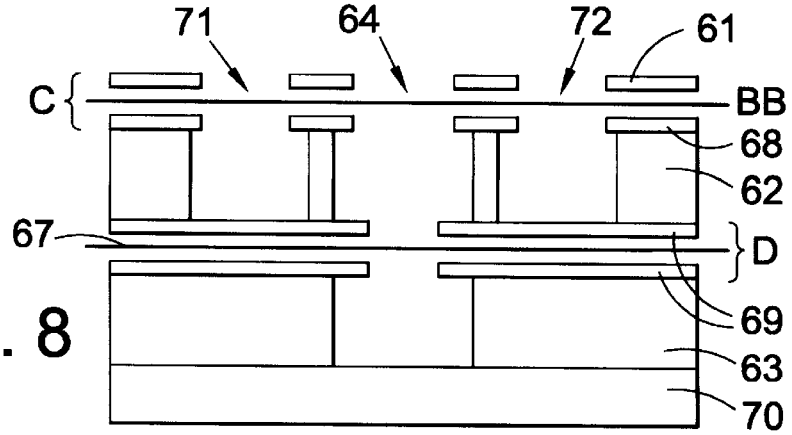
FIG. 8 is a cross-section along line B—B of FIG. 6.

FIG. 7 shows a cross section along line A—A of FIG. 6. This illustrates that the structure of the dual band antenna elements is the same as that for the embodiment illustrated in FIG. 4. FIG. 8 shows a cross section long line B—B of FIG. 8 which incorporates one dual band antenna element 52 and two single band antenna elements 51. For the dual band antenna element apertures 64, 65 are present in both triplates C and D. However for the single band antenna elements no apertures need be provided in the lower triplate D and no apertures are provided in the honeycomb spacer 63 between the back-plate 70 and the second triplate D.

Figure 4:
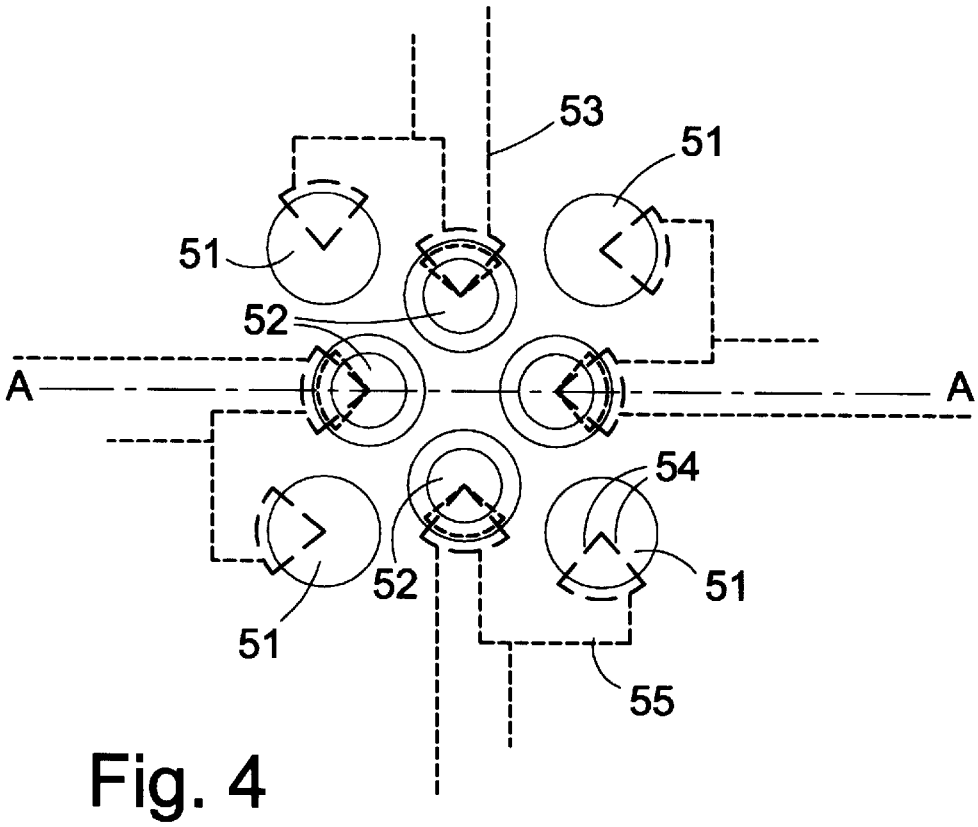
FIG. 4 is a schematic diagram of a dual band array feed for a reflector antenna.

Another example of a Ka—Ka reflector feed is illustrated in FIG. 4. The array feed comprises four dual band antenna elements 52 which are similar to those described above for the flat plate antenna array. In addition four single band antenna elements 51 are provided. Each single band antenna element 51 comprises a pair of probes 54 which are connected to a distribution network 55 as described above for the flat plate antenna array. Each dual band antenna element 52 has two pairs of probes (shown as superimposed dotted lines in FIG. 4) which are also connected to the distribution network 55. The problem of providing enough space between the antenna elements 51, 52 in order to accommodate the distribution network arises again as for the flat plate antenna array described above.

The four single band antenna elements 51 are arranged at the corners of a square and the four dual band antenna elements 52 are positioned within this square. The four dual band antenna elements 52 are also positioned at the corners of a smaller second square which is concentric with the square formed by the single band elements 51. The second square has an axis of reflection which is positioned at about 45° with respect to the corresponding axis for the first square. This arrangement is advantageous because it allows enough space for the distribution network to be accommodated between the elements as indicated in FIG. 4. The element spacings are approximately the same as for the embodiment of FIG. 6 as are the aperture sizes.

In this case no tapering of the illumination is required in order to obtain approximately equal beamwidths. This is because pairs of the "receive only" elements from the embodiment in FIG. 6 are effectively replaced by a single "receive only" element. In the embodiment in FIG. 6 the receive only elements were activated at 50% of the activation level of the transmit probes and thus single receive only elements in the embodiment of FIG. 4 may be activated at the same level as the transmit probes.

Figure 5:
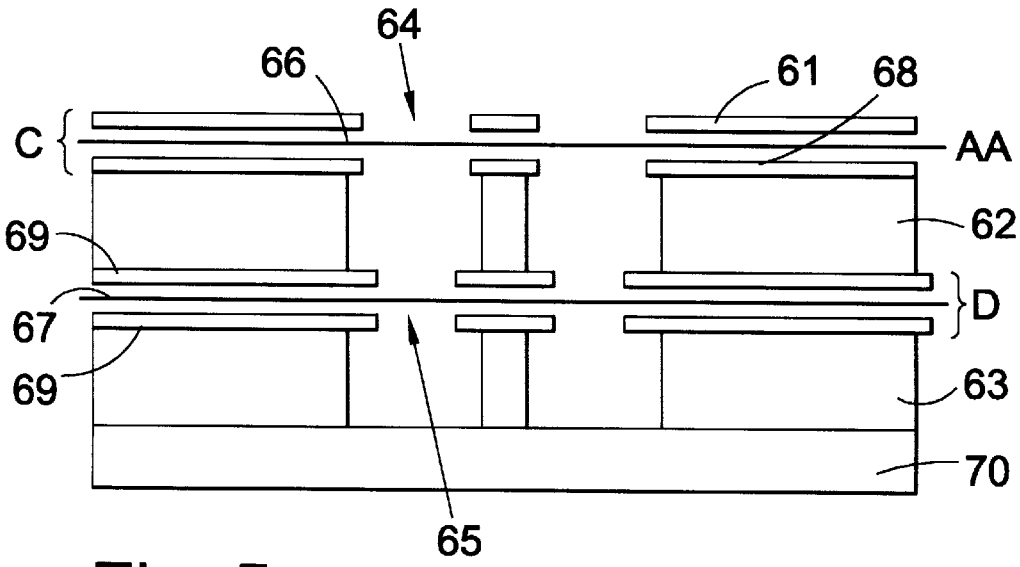
FIG. 5 is a cross-section along line A—A of FIG. 4.

FIG. 5 shows a cross-section along line AA of FIG. 4. This shows how the structure of the individual dual band antenna elements 52 is the same as that described above for the flat-plate antenna array. A dielectric film 66 is provided which supports a distribution network 55 and pairs of probes. This dielectric film 66 is positioned between two first metal plates 61, 68 to form a first triplate C. The two first metal plates 61, 68 contain apertures 64 which correspond and are superimposed as described above for the flat-plate antenna array. A pair of probes is arranged to extend under each aperture 64 in the uppermost first metal plate 61.

A second triplate D is also provided below the first triplate C. This second triplate D comprises two metal plates 69 and a dielectric film 67 supporting a distribution network. Apertures 65 are punched in the metal plates 69 of the second triplate D in the same way as for the flat-plate antenna array described above. The apertures 65 in the metal plates 69 of the second triplate D are smaller than those in the metal plates of the first triplate C. As for the flat-plate antenna array described above a honeycomb spacer 62 is provided between the first triplate C and the second triplate D. A back-plate 70 is positioned below the second triplate D and a honeycomb spacer 63 is located between this back-plate 70 and the second triplate D. Again this is the same as for the flat-plate antenna array described above.

The dual-band array elements 52 operate in the same way as described above for the dual band array elements in the flat-plate antenna array.

The single band array elements 51 can have the same structure as the dual band array elements except that no probes are provided in the second triplate D. However, for the single band array elements 51 the functionality of the second triplate is not required. This means that for a single band array element no apertures are required in the metal plates of the second triplate D and no channel is required in the honeycomb spacer 63 between the second triplate D and the back-plate 70.

Figure 9:
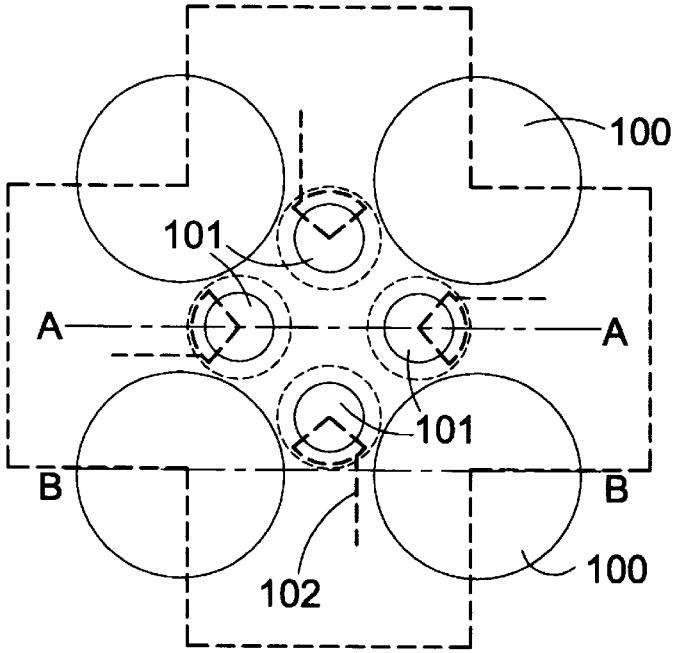
FIG. 9 is a schematic diagram of another example of a dual band array feed for a reflector antenna.

FIG. 9 illustrates another example of a dual band array feed for a reflector antenna. In this case the frequency bands provided are around 30 GHz for transmission and 12 GHz for reception. This is termed a "Ka—Ku" reflector feed. In this example all the antenna array elements are single band elements. Again, it is required to provide substantially equal beamwidths with substantially co-incident phase centers for the beams. Four single band transmit elements 101 are provided, positioned in a first square grid. Four single band receive elements 100 are also provided, positioned in a second square grid that is concentric with the first square grid. The first square grid is located inside the second square grid as shown and an axis of reflection of the first square grid is positioned at about 45° with respect to a corresponding axis for the second square grid. As for the antenna array feeds described above, a distribution network 102 is provided together with a pair of probes for each single band antenna element 100, 101. The receive elements 100 are larger than the transmit elements 101 because the aperture size must be about ½ a wavelength and the spacing between the receive elements 100 is also greater than that between the transmit elements 101 (again because the element spacing must be less than one wavelength in order to avoid grating lobes). In a preferred example the diameter of the transmit elements is 5 mm (about half of one 10 mm transmit wavelength) and the spacing between these elements 8.5 mm (just less than one transmit wavelength). For the receive elements, the diameter is about 12 mm (about half of one 25 mm receive wavelength) and the element spacing about 21 mm (just less than one 25 mm receive wavelength). The beamwidths of the transmit and receive beams are approximately equal by virtue of this arrangement with the transmit beamwidth being about 8.5/10 mm and the receive beamwidth being about 21/25 mm.

Figure 10:
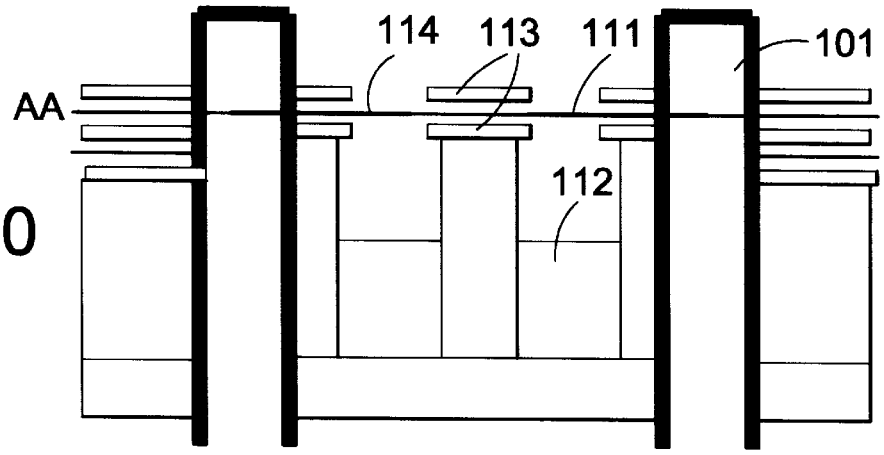
FIG. 10 is a cross-section along line A—A of FIG. 9.
Figure 11:
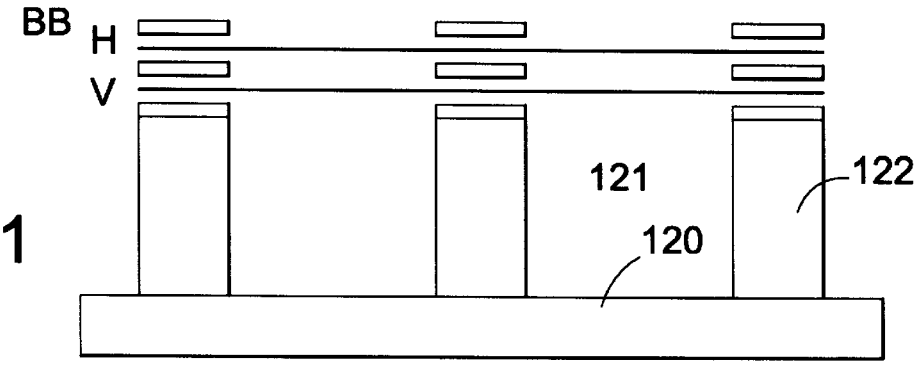
FIG. 11 is a cross-section along line B—B of FIG. 9.
Figure 12:
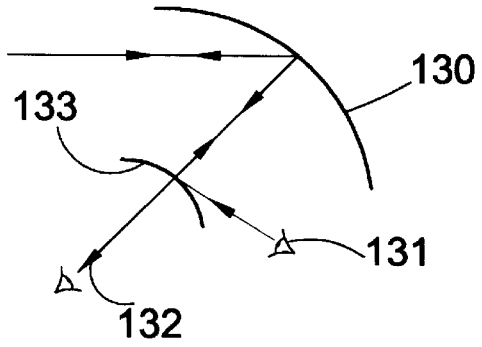
Fig.12 PRIOR ART
FIG. 12 illustrates use of a frequency selective surface in a dual band reflector antenna according to the prior art.

FIG. 10 is a cross section along line A—A of FIG. 9 and incorporates two transmit elements 101. Each transmit element 101 comprises a triplate with two metal layers 113 containing apertures as for the triplates described above for the flat-plate antenna array. Between the metal plates 113 is a distribution network supported on a dielectric film. Probes 111, 114 extend between two apertures in the metal layers 113 as for the triplates described above for the flat-plate antenna array.

Below the triplate a honeycomb spacer 112 is provided which may be made of any suitable dielectric material such as foamed plastic but with the internal walls of cavities or apertures in the honeycomb spacer being metallised (see below). The honeycomb spacer 112 contains cavities with one cavity being located beneath each transmit and each receive element. Each cavity is arranged to have a diameter that is greater than or approximately equal to the diameter of the aperture above it. For a cavity below a transmit element the cavity diameter is arranged such that transmit signals may propagate along the cavity. Similarly, for a cavity below a receive element the cavity diameter is arranged such that receive signals may propagate along the cavity. Preferably, the cavities below the transmit elements have a diameter of 7.5 mm and the cavities below the receive elements have a diameter of 14 mm. As for the flat-plate antenna array discussed above the internal walls of the cavities or apertures in the honeycomb spacer 112 are metallised or provided with electrically conducting material in order that radiation may propagate along the cavity. The depth of the cavities is arranged to be about ¼ (or a multiple of ¼) of a wavelength for the same reasons as discussed above for the flat-plate array antenna.

Although the examples of dual band array feeds for reflector antennas discussed above have been described for providing frequency bands of about 30 GHz and 12 GHz, the arrangements can be used for any frequency bands which are in the ratio of approximately 2.5:1.

Figure 13:
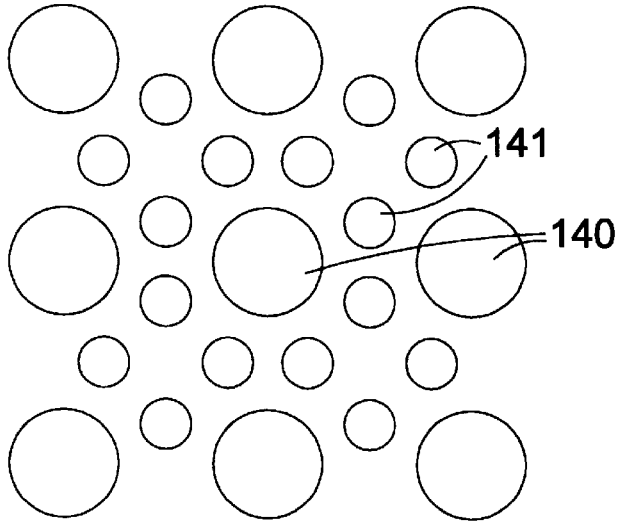
FIG. 13 shows an arrangement of array elements that is not suitable for use in a dual band array feed for a reflector antenna.
Figure 14:
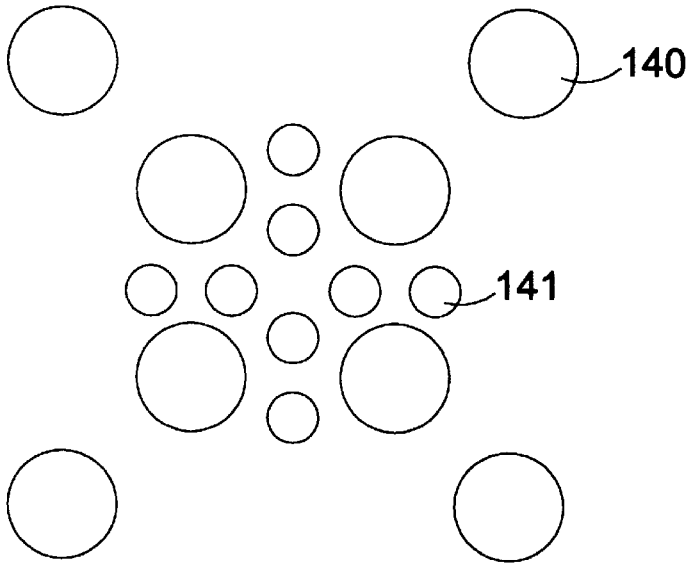
FIG. 14 shows another arrangement of array elements.

FIG. 13 shows the result of trying to extend the reflector feed of FIG. 9 to include more transmit and receive elements by tessellating the reflector feed elements of FIG. 9. The resulting grid of elements is not a so called "filled grid" because there are no transmit elements 141 in the center of the grid in the region occupied by the central receive element 140. Because the grid is not filled the feed does not provide beams which are able to cover a reflector completely and efficiently. FIG. 14 shows an alternative arrangement of transmit 141 and receive 140 elements which does involve a filled grid. Monopulse alignment is possible with the reflector antennas described above because multiple receive antenna elements are available.

Distributed power amplification is possible with the reflector antennas described above because multiple transmit antenna elements are available.

A range of applications are within the scope of the invention. These include situations in which it is required to form a dual band flat plate array element or a dual band flat plate array antenna incorporating such elements. The invention also encompasses dual band flat plate array feeds for a reflector antenna. These antenna elements, feeds and antennas may be used for two-way satellite communication such as interactive television. The range of applications also includes terrestrial communication systems and any application where it is required to provide dual band communication for example, two-way satellite communication.

We claim:

1. A dual band flat plate antenna array element comprising:

(i) at least one transmit probe positioned between two first metal plates, the first metal plates each containing an aperture of the same size and shape, and the apertures in the first metal plates being positioned one above the other and overlying the transmit probe;

(ii) at least one receive probe positioned between two second metal plates, the second metal plates each containing an aperture of the same size and shape and the apertures in the second metal plates being positioned one above the other and overlying the receive probe; and wherein said apertures in the first and second metal plates are superimposed, the apertures in the first metal plates being of a different size from that of the apertures in the second metal plates.

2. The antenna array element as claimed in claim 1 which further comprises a propagator positioned between the lower of the first metal plates and the upper of the second metal plates and arranged to propagate radiation between the lower of the first metal plates and the upper of the second metal plates.

3. The antenna array element as claimed in claim 2 wherein said propagator comprises a channel which has inner walls that are electrically conductive.

4. The antenna array element as claimed in claim 3 wherein said propagator further comprises a dielectric layer, said channel forming an aperture through the dielectric layer.

5. The antenna array element as claimed in claim 1 which further comprises a back-plate positioned below the lower of the second metal plates and arranged to reflect radiation.

6. The antenna array element as claimed in claim 5 which further comprises a propagator positioned between the lower of the second metal plates and the back-plate and arranged to propagate radiation between the lower of the second metal plates and the back-plate.

7. A dual band flat plate array antenna comprising a plurality of dual band flat plate antenna array elements each of said elements comprising:

(i) a transmit probe positioned between two first metal plates, the metal plates each containing an aperture of the same size and shape, and the apertures in the first metal plates being positioned one above the other and overlying the transmit probe;

(ii) a receive probe positioned between two second metal plates, the second metal plates each containing an aperture of the same size and shape and the apertures in the second metal plates being positioned one above the other and overlying the receive probe; and wherein said apertures in the first and second metal plates are superimposed, the apertures in the first metal plates being of a different size from that of the apertures in the second metal plates.

8. The antenna array as claimed in claim 7 which further comprises a plurality of single band flat plate array elements.

9. The antenna array as claimed in claim 8 wherein the ratio of dual band flat plate array elements to single band flat plate array elements is about 2:1.

10. The antenna array as claimed in claim 8 wherein all the array elements are arranged in a first array; and wherein the dual band elements are arranged in a second array which is part of the first array; and wherein the spacing between the elements in the first array is smaller that that between the elements of the second array.

11. The antenna array as claimed in claim 10 wherein the ratio of the element spacing in the first array to the second array is about $1:2^{1/2}$.

12. The antenna array as claimed in claim 10 wherein an axis of reflection of the first array is arranged at approximately 45° to a corresponding axis of reflection of the second array.

13. A flat-plate array feed for a reflector antenna said array feed comprising:

(i) a plurality of dual band antenna elements; and (ii) a plurality of single band antenna elements; wherein the geometric arrangement of said antenna elements is such that a receive and a transmit antenna beam are provided with approximately equal beamwidths and approximately equal phase centers.

14. The array feed as claimed in claim 13 wherein each dual band antenna element comprises:

(i) at least one transmit probe positioned between two first metal plates, the metal plates each containing an aperture of the same size and shape, and the apertures in the first metal plates being positioned one above the other and overlying the transmit probe;

(ii) at least one receive probe positioned between two second metal plates, the second metal plates each containing an aperture of the same size and shape and the apertures in the second metal plates being positioned one above the other and overlying the receive probe; and wherein said apertures in the first and second metal plates are superimposed, the apertures in the first metal plates being of a different size from that of the apertures in the second metal plates.

15. The array feed as claimed in claim 13 wherein the single band antenna elements are arranged in a first array; and wherein the dual band elements are arranged in a second array and wherein the second array is contained within the first array.

16. The array feed as claimed in claim 15 which comprises 4 single band antenna elements and four dual band antenna elements.

17. A flat-plate array feed for a reflector antenna said array feed comprising:

(i) a plurality of dual band antenna elements; and (ii) a plurality of single band antenna elements; wherein said antenna elements are arranged in an array and the geometric arrangement of said antenna elements is such that a receive and a transmit antenna beam are provided a with approximately equal phase centers.

18. The array feed as claimed in claim 17 which further comprises a distribution network connected between a plurality of said antenna elements and arranged to taper the illumination of said plurality of antenna elements such that in use a receive and a transmit antenna beam are provided with approximately equal beamwidths.

19. The array feed as claimed in claim 17 which comprises 8 single band antenna elements and four dual band antenna elements.

20. A flat-plate array feed for a reflector antenna said array feed comprising a plurality of first single band antenna elements that are arranged to operate within a first frequency band; a plurality of second single band antenna elements that are arranged to operate within a second frequency band which is substantially different from the first frequency band; and wherein the geometric arrangement of said first and second antenna elements is such that an antenna beam for the first frequency band and an antenna beam for the second frequency band are provided with approximately equal beam widths and approximately equal phase centers.

21. The array feed as claimed in claim 20 comprising only 4 first single band elements positioned at corners of a square and only 4 second single band elements positioned at corners of a square.

22. The array feed as claimed in claim 21 wherein said squares are concentric.

23. The array feed as claimed in claim 22 wherein an axis of reflection of one of said squares is positioned at 45° with respect to a corresponding axis of reflection for the other square.

24. The array feed as claimed in claim 20 wherein each of said antenna beams is provided in a frequency band and wherein the ratio of said frequency bands is about 2.5:1.

25. A reflector antenna comprising a flat-plate array feed said flat-plate array feed comprising:

(i) a plurality of dual band antenna elements; and (ii) a plurality of single band antenna elements; wherein the geometric arrangement of said antenna elements is such that a receive and a transmit antenna beam are provided with approximately equal beamwidths and approximately equal phase centers.

26. A reflector antenna comprising a flat-plate array feed said flat plate array feed comprising:

(i) a plurality of dual band antenna elements; and (ii) a plurality of single band antenna elements; wherein said antenna elements are arranged in an array and the geometric arrangement of said antenna elements is such that an antenna beam for a first frequency band and an antenna beam for a second frequency band are provided with approximately equal phase centers.

27. A reflector antenna comprising a flat-plate array feed said flat-plate array feed comprising:

a plurality of first single band antenna elements that are arranged to operate within a first frequency band; a plurality of second single band antenna elements that are arranged to operate within a second frequency band which is substantially different from the first frequency band; and wherein the geometric arrangement of said first and second antenna elements is such that an antenna beam for the first frequency band and an antenna beam for the second frequency band are provided with approximately equal beam widths and approximately equal phase centers.

* * * * *